US006224178B1

(12) United States Patent
Cirocco

(10) Patent No.: US 6,224,178 B1
(45) Date of Patent: May 1, 2001

(54) MULTI-USE SNAP-PART BODY FOR SLIDER

(75) Inventor: Paul Cirocco, Yorba Linda, CA (US)

(73) Assignee: Jonathan Manufacturing Corporation, Fullerton, CA (US)

( * ) Notice: Subject to any disclaimer, the term of this patent is extended or adjusted under 35 U.S.C. 154(b) by 0 days.

(21) Appl. No.: 09/326,813

(22) Filed: Jun. 7, 1999

Related U.S. Application Data

(62) Division of application No. 08/972,595, filed on Nov. 18, 1997, now Pat. No. 5,951,132.

(51) Int. Cl.[7] ..... A47B 88/00
(52) U.S. Cl. ..... 312/334.46; 312/334.8
(58) Field of Search ..... 312/334.16, 334.36, 312/333; 384/4, 18, 20, 21, 23, 22, 34, 38, 42, 10

(56) References Cited

U.S. PATENT DOCUMENTS

| | | | |
|---|---|---|---|
| D. 291,636 | 9/1987 | Rechberg . | |
| D. 385,474 | 10/1997 | Rechberg . | |
| 2,528,910 | 11/1950 | Poe . | |
| 3,923,347 | 12/1975 | Dean | 312/334 |
| 4,370,007 | 1/1983 | Fler . | |
| 4,469,384 | 9/1984 | Fler et al. . | |
| 4,573,731 | 3/1986 | Knaack et al. . | |
| 4,747,242 | 5/1988 | Aarstad . | |
| 4,749,242 | 6/1988 | Rechberg . | |
| 4,872,734 | 10/1989 | Rechberg . | |
| 4,986,674 * | 1/1991 | Decker et al. | 384/23 |
| 4,998,828 | 3/1991 | Hobbs | 312/333 |
| 5,085,523 | 2/1992 | Hobbs . | |
| 5,169,238 | 12/1992 | Schenk . | |
| 5,181,782 * | 1/1993 | Wojcik | 384/21 |
| 5,388,902 | 2/1995 | Huebschen et al. . | |
| 5,411,333 | 5/1995 | Hoffman . | |
| 5,466,060 | 11/1995 | Hoffman . | |
| 5,507,571 | 4/1996 | Hoffman . | |
| 5,564,767 | 10/1996 | Strepek . | |
| 5,570,915 | 11/1996 | Asadurian . | |
| 5,577,821 | 11/1996 | Chu . | |
| 5,588,686 | 12/1996 | Riley et al. . | |
| 5,671,988 | 9/1997 | O'Neill | 312/333 |

FOREIGN PATENT DOCUMENTS

| | | |
|---|---|---|
| 3518359 | 11/1986 | (DE) . |
| 0585037A1 | 3/1994 | (EP) . |

* cited by examiner

*Primary Examiner*—Janet M. Wilkens
*Assistant Examiner*—Jerry A. Anderson
(74) *Attorney, Agent, or Firm*—Knobbe, Martens, Olson & Bear LLP

(57) ABSTRACT

Disclosed is a multi-section slide assembly comprising a plurality of rails slidably mounted to one another. A rail controller is configured to control the slidability of the rails relative to one another. The rail controller is advantageously mounted in a press-fit fashion to one of the rails. The rail controller comprises a body having an alignment member extending outward from a mating surface for positioning the rail controller on the rail. A pair of interlock members are attached to the main body and are configured to be mounted between roll forms of one of the rails. Advantageously, the interlock members are configured to flex toward one another to reduce the width of the main body during mounting.

8 Claims, 18 Drawing Sheets

MULTI-USE SNAP-PART BODY FOR SLIDER

This Appln is a Div of Ser. No. 08/972,595 filed Nov. 18, 1997, U.S. Pat. No. 5,951,132.

FIELD OF THE INVENTION

The present invention relates to slide assemblies. More particularly, the present invention relates to slide assemblies for slidably mounting an object within a receptacle.

DISCUSSION OF THE RELATED ART AND SUMMARY OF THE INVENTION

Slide assemblies are mechanisms that are used to slidably mount objects, such as drawers, within a receptacle. A typical slide assembly comprises two or more rails that are coupled to each other such that the rails slidably move relative to one another along the longitudinal axes of the rails. Generally, the rails of the slide assembly are slidably movable between an open and a closed position. In the closed or non-extended position, an inner rail is fully nested within an outer rail of the rail assembly. In the open or extended position, the majority of the inner rail extends beyond the end of the outer rail so that only a portion of the inner rail is nested within the outer rail.

Slide assemblies are often used in environments that entail certain performance requirements regarding the moveability of one rail relative to another. For example, certain uses may require that the slide assemblies can be locked in either the open or the closed position. When locked in a given position, the slide assembly may only be closed or opened upon actuation of a control mechanism attached to the assembly. Alternatively, some uses may require that the slide assemblies can be moved out of the opened or closed position only if a certain threshold level of force is applied to the rails.

Currently, a control piece or mechanism is mounted to one or more of the rails in the slide assembly to regulate the movement of the rails relative to each other, such as described above. The type of control piece mounted to the rail assembly may be varied depending on the desired control characteristics of the rail assembly. The control piece is usually fixedly mounted to one of the rails in the slide assembly using attachment devices such as rivets, tabs, nails, screws, etc. The control piece may also be mounted through spot welding. Unfortunately, several drawbacks are associated with fixedly mounting a control piece to the rail.

For example, the use of special tools is required to mount the control piece with rivets or welding. This increases the expense of mounting the control piece to the rails, and also increases the amount of time required for installation. Moreover, the control piece may not be installed if such tools are not readily available.

Another drawback relates to the control piece being installed in the wrong position or orientation relative the rails of the slide assembly. It is difficult to remove an incorrectly-mounted control piece from the rails if the control piece is fixedly mounted using rivets or welding. As a result, if the control piece is incorrectly mounted, the slide assembly may be unusable. Even if the control piece is successfully removed, the rail is often left with unsightly holes or weld spots where the control piece was previously mounted.

There is therefore a need for a control piece that may easily attached to and removed from a slide assembly. Desirably, the control piece will not require the use of special tools or attachment devices and methods, such as screws, rivets or welding. Additionally, the control piece should be easily manufactured.

One aspect of the invention is a multi-section slide assembly particularly adapted to satisfy the foregoing needs. The assembly includes an elongate first rail, an elongate second rail, a first plurality of ball bearings, a second plurality of ball bearings, and a rail control. The first rail includes a first elongate web, between a first elongate outer roll form on one side and a second elongate outer roll form on an opposing side. The elongate second rail includes a second elongate web and is positioned between a first elongate inner roll form on one side and a second elongate inner roll form on a opposing side. The first inner roll form defines a first surface overhanging the second web and the second inner roll form defines a second surface overhanging the second web which defines a first opening. The first plurality of ball bearings is nested between the first outer roll form and the first inner roll form. Additionally, the second plurality of ball bearings is nested between the second outer roll form and the second inner roll form. Advantageously, the rail control comprises a body defining a mating surface and an alignment member raised with respect to the mating surface, the alignment member being sized and shaped to be received by the first opening of the second rail. The control further comprises a first foot portion along one side and a second foot portion along an opposing side. The first foot portion is sized and shaped to be secured between the second web and the first overhanging surface. The second foot portion is sized and shaped to be secured between the second web and the second overhanging surface.

Another aspect of the invention relates to a method of controlling movement of a slide assembly including a first rail section having a first roll form and a second roll form, a second rail section having a first roll form and a second roll form and a controller having a first foot portion and a second foot portion. The method comprises inserting the first foot portion between a web portion and a first overhanging portion of the first rail, aligning the first alignment member with the opening, and forcing the second foot portion between the first roll form and the second roll form until the second foot portion is positioned between the web portion and a second overhanging portion of the first rail.

Yet another aspect of the invention relates to a method of manufacturing a series of controllers for a slide assembly. The method comprises providing a base mold having a relief for molding a body defining a first end, a second end, a first side, a second side, a mating surface, an alignment member extending outward from the mating surface, a first interlock member along an outer portion of the first beam member and a second interlock member along an outer portion of the first beam member. The method further comprises selecting a first attachment mold insert from the group of lock, detent, and blank molds, inserting the first attachment mold insert at a first end of the relief, selecting a second attachment mold insert from the group of lock, detent, and blank molds, inserting the second attachment mold insert at a second end of the relief, and molding a controller.

In yet another aspect of the invention, there is disclosed an improved rail controller. The controller comprises a body defining a first end, a second end, a first side, a second side, a mating surface, and an alignment member extending outward from the mating surface. The body defines a first elongate aperture and a first beam member along the first side of the body outboard from the first elongate aperture. The first aperture is sized and shaped to permit the first beam member to flex inward. A first interlock member is positioned along an outer portion of the first beam member. The body further defines a second elongate aperture and a second beam member along the second side of the body outboard from the second elongate aperture. The second aperture is sized and shaped to permit the second beam member to flex inward. A second interlock member is positioned along an outer portion of the first beam member.

BRIEF DESCRIPTION OF THE DRAWINGS

These and other features of the invention will now be described with reference to the drawings of a preferred embodiment, which are intended to illustrate and not to limit the invention, and in which.

DETAILED DESCRIPTION OF THE PREFERRED EMBODIMENT

Figure 1:
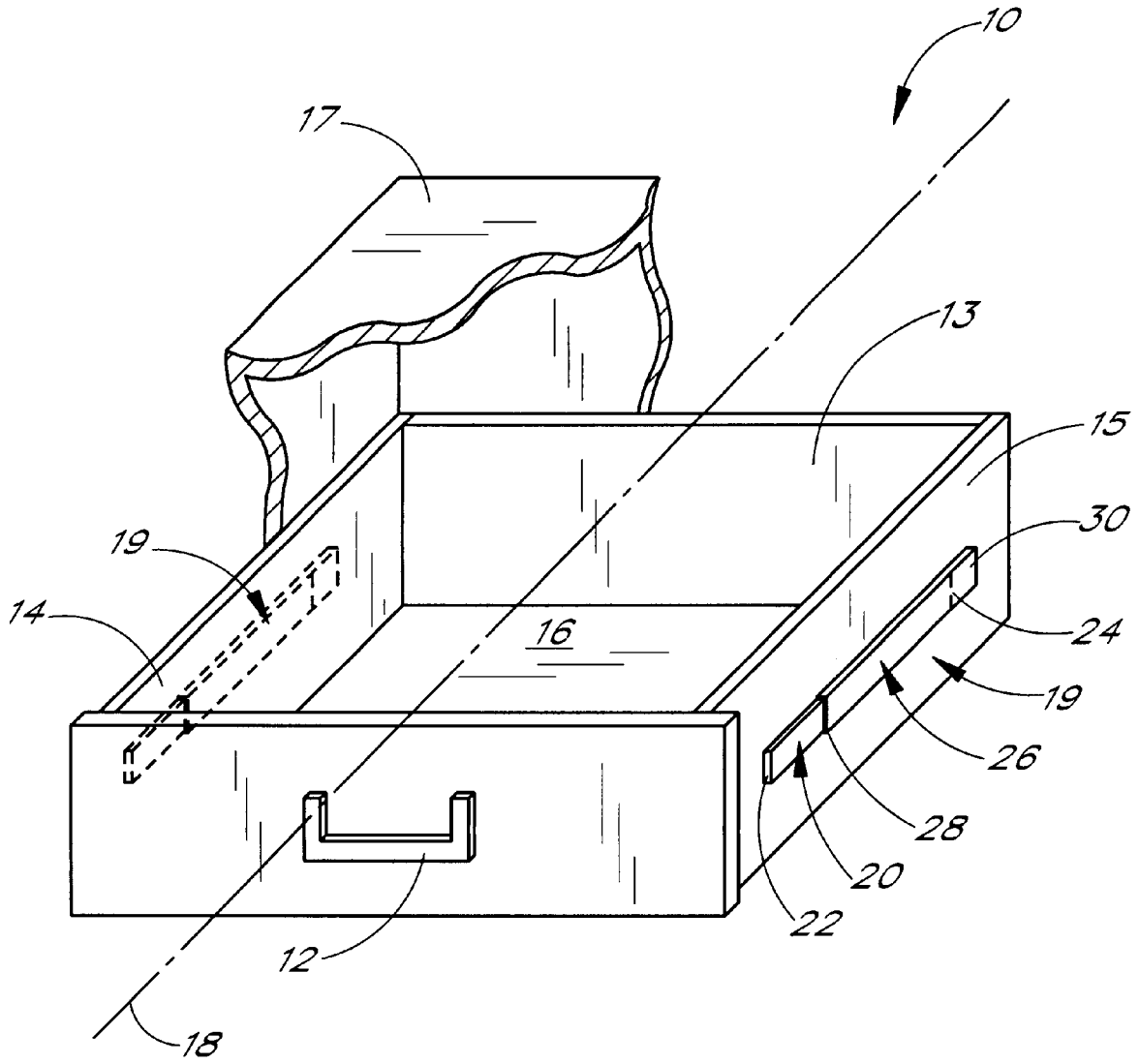
FIG. 1 is a perspective view of a drawer utilizing a pair of rail assemblies of the present invention.

FIG. 1 illustrates a drawer 10 comprising four walls including a front wall 11 having a handle 12, an opposed rear wall 13, and a pair of opposed side walls 14, 15 oriented orthogonally to the front and rear walls. A bottom wall 16 defines the bottom surface of the drawer 10. The drawer 10 may be slidably mounted within a receptacle 17 (shown in cut-away) using the slide assemblies described herein. For illustrative purposes, the slide assembly of the present invention is described herein in accordance with one embodiment for use in connection with the drawer 10. However, it is appreciated that the principles described herein are also readily applicable with other applications that use slide assemblies.

For reference purposes, a longitudinal center-line 18 is shown extending through the center of the drawer 10. As used herein, the term "outboard" refers to a direction moving or facing away from the longitudinal center-line 18 of the drawer 10. The term "inboard" refers to a direction moving or facing toward the center-line 18.

A slide assembly 19 is mounted on each of the opposed side walls 14, 15 of the drawer 10 in a well known manner, such as with screws, rivets, tabs, etc. Each of the slide assemblies 19 generally comprises an elongated inboard or inner rail 20 having a proximal end 22 and a distal end 24. An elongated outboard or outer rail 26 having a proximal end 28 and a distal end 30 is mounted outboard of the inner rail 20 and is slidably movable over the inner rail 20 along its longitudinal axis. As used herein, the words "proximal" and "distal" are with reference to the front wall 11 of the drawer 10. The inner rails 20 of the slide assemblies 19 are fixedly mounted to the outboard sides of the drawer side walls 14 and 15 in a well known manner. The corresponding outer rails 26 are fixedly mounted to inboard surfaces of the receptacle 17. The drawer 10 slides out of the receptacle 17 by sliding the inner rails 20 longitudinally relative to the outer rails 26.

Figure 2:
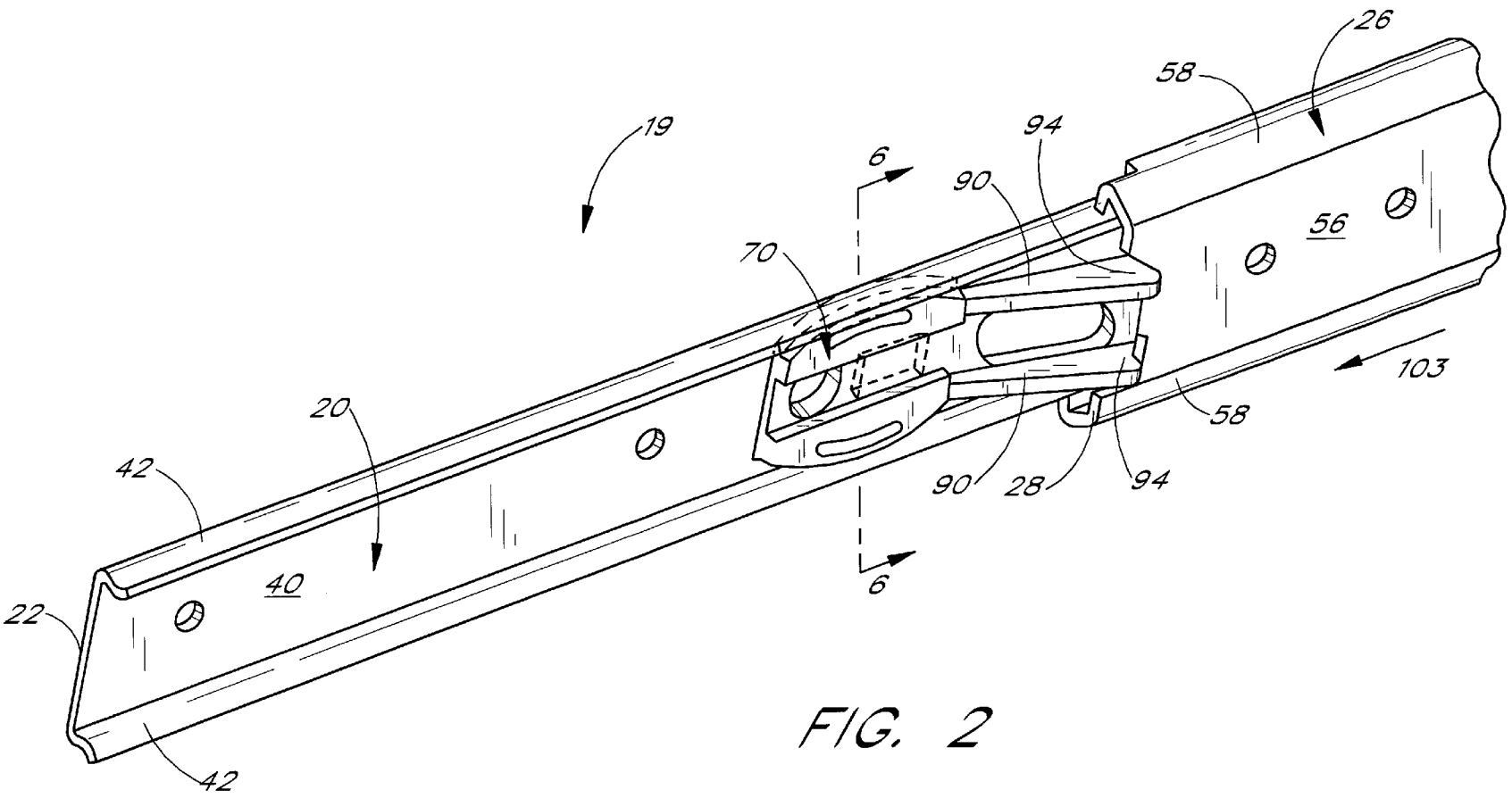
FIG. 2 is a perspective view of a rail assembly utilizing a rail controller of the present invention.

FIG. 2 is a perspective view of a first embodiment of the slide assembly 19. In FIG. 2, the slide assembly 19 is shown in an "open" position wherein the inner rail 20 is longitudinally extended relative to the outer rail 26. In the open position, only a portion of the inner rail 20 is nested within the outer rail 26 so that the proximal end 22 of the inner rail 20 is spaced from the proximal end 28 of the outer rail 26.

Figure 6:
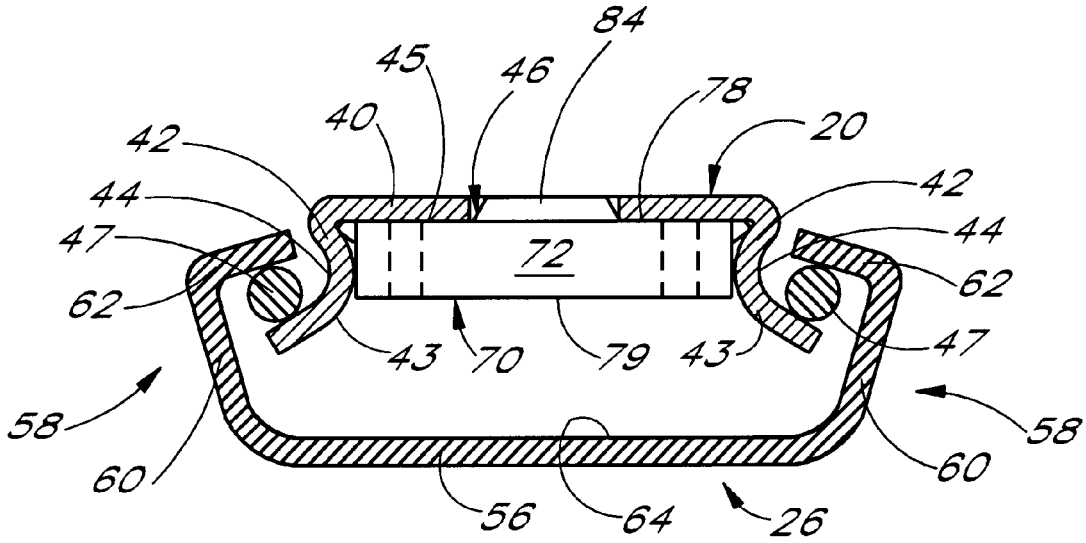
FIG. 6 is a cross-sectional view of the rail assembly of FIG. 2 taken along the line 6—6.

The structural configuration and relationship of the components of the slide assembly 19 are best understood from FIG. 2 in combination with FIG. 6, which is a cross-sectional view of the slide assembly 19 along the line 6—6 of FIG. 2. As best shown in FIG. 6, the inner rail 20 and outer rail 26 are mated together in an interlocking fashion with a portion of the inner rail 20 nested within the outer rail 26, as described in detail below.

The inner rail 20 is elongated and includes a substantially flat and thin mid-portion or first elongate web 40 that extends along the entire length of the inner rail 20. A pair of curved outer roll forms 42 extend from the side edges of the first elongate web 90 along the entire length of the inner rail 20. As best shown in FIG. 6, the outer roll forms 42 comprise a pair of curved walls defining opposed convex surfaces 43 and concave surfaces 44 opposite the convex surfaces 43. The convex surfaces 43 define a space therebetween with the space having a minimum size at the apex of the convex surfaces.

The convex surfaces 43 of the outer roll forms 42 overhang a flat outboard surface 45 of the first elongate web 40.

A rectangular alignment opening 46 extends through the first elongate web 40 of the inner rail 20. The alignment opening 46 is preferably aligned with the longitudinal center-line of the elongate web 40.

Referring still to FIGS. 2 and 6, the outer rail 26 is sized and shaped to slidably mate with the inner rail 20. Specifically, the outer rail 26 includes a substantially flat and thin midportion or second elongate web 56 that extends parallel to the first elongate web 40 of the inner rail 20. A pair of outer roll forms 58 extend from the edges of the second elongate web 56 along the entire length of outer rail 26. As best shown in FIG. 6, the outer roll forms 58 each comprise a bent wall including first wall portion 60 that extends from the elongate web 56 at an angle. The outer roll forms 58 then bend to form a second wall portion 62 that overhangs the second elongate web 56. The second wall portions 62 extend toward the concave surfaces 44 of the inner roll forms 42 of the inner rail 20.

As best shown in FIG. 6, the second wall portions 62 of the outer roll forms 58 define a space therebetween in which the concave surfaces 44 of the inner roll forms 42 are slidably mounted. A plurality of ball bearings 47 are positioned between the inner roll forms 42 and outer roll forms 58.

The slide assembly 19 further comprises a rail controller 70 that is removably mounted to the inner rail 20 in a press-fit or snap-fit fashion, as described in more detail below. As best shown in FIG. 6, the rail controller 70 includes a substantially thin flat main body 72 that is sized to fit snugly between the walls of the inner roll forms 42 of the inner rail 20. The main body 72 desirably has a small enough thickness such that the main body 72 fits between the inner roll form 40 and outer roll form 56 without interfering with the slidability of the inner rail 20 relative to the outer rail 26. As shown, a clearance is provided between a flat slide surface 79 of the main body and a flat inboard surface 64 of the outer elongate web 56.

The main body 72 has a flat mating surface 78 that is positioned flush against the outboard surface 45 of the first elongate web 40 of the inner rail 20. An alignment member 84 comprising a raised projection extends from the mating surface 78 of the main body and is positioned within the alignment opening 46 in the inner rail 20, as described more fully below.

Figure 3:
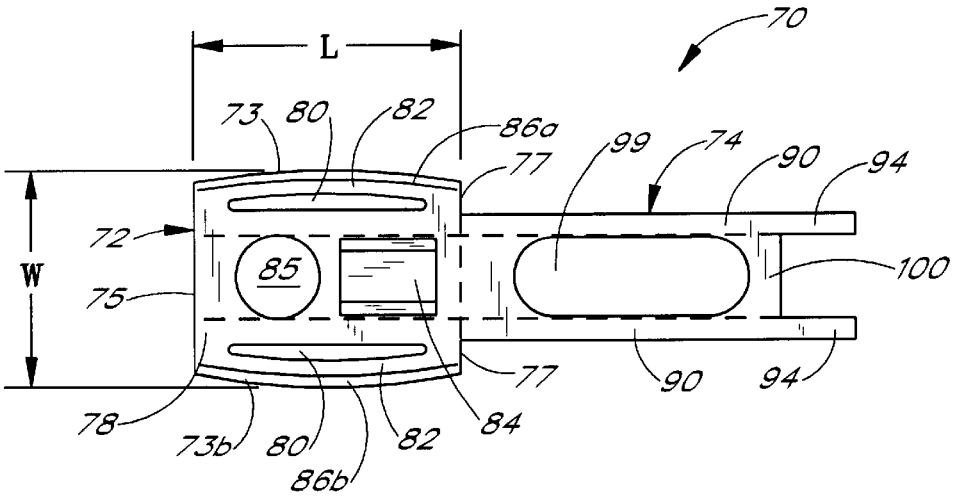
FIG. 3 is a top view of the rail controller of FIG. 2.
Figure 4:
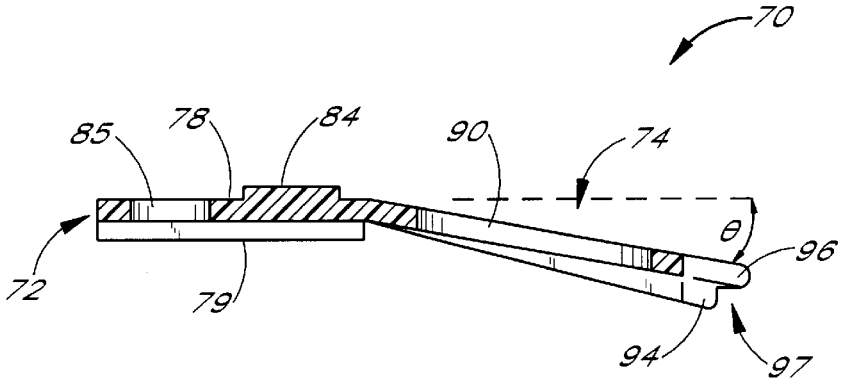
FIG. 4 is a side view of the rail controller of FIG. 2.
Figure 5:
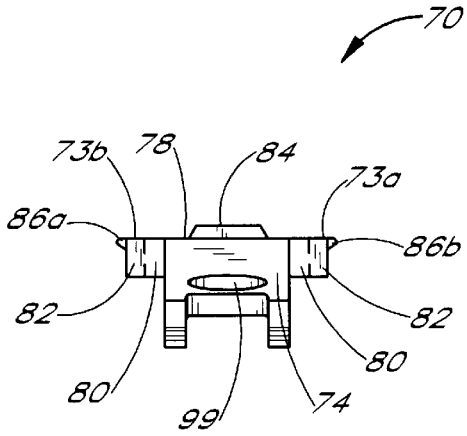
FIG. 5 is a front view of the rail controller of FIG. 2.

FIGS. 3, 4, and 5 are top, side and front views, respectively, of the rail controller 70. The main body 72 of the rail controller 70 is thin and defines the flat controller mating surface 78 on one side and the flat slide surface 79 on the opposite side. As best shown in FIG. 3, the main body 72 has a substantially rectangular-top profile and defines a pair of opposed, curved side edges 73*a*, 73*b*, a straight proximal edge 75, and an opposed straight distal edge 77. The main body 72 has a width W, defined as the distance between the side edges 73*a*, 73*b*, and also has a length L, defined as the distance between the proximal edge 75 and the distal edge 77.

As best shown in FIG. 3, a pair of substantially parallel elongated apertures 80 extend through the main body 72 near and parallel to the side edges 73*a* and 73*b*. In the illustrated embodiment, the edges of the elongated apertures 80 are curved adjacent the side edges 73*a* and 73*b* and are flat opposite the side edges 73*a* and 73*b*, so that the elongated apertures 80 widen at their midpoint.

With reference to FIG. 3, the elongated apertures 80 each define a pair of elongated beam members 82 on either side thereof. Specifically, the beam members 82 comprise the portions of the main body 72 located between the side edges 73*a*, 73*b* and the respective elongated apertures 80 so that the beam members 82 extend lengthwise along the side edges 73*a* and 73*b*. Desirably, the side edges 73*a* and 73*b* of the main body 72 conform to the curvature of the elongated apertures 80 such that the beam members 82 each have a substantially uniform width along their length. Preferably, the beam members 82 are configured to flex inward toward the elongated apertures 80 so as to reduce the width W of the main body 72. The beam width may be varied to modify the amount of force necessary to flex the beam members 82 and to control the amount of force that the beam members 82 apply to the roll forms 62 when mounted to the inner rail 20.

As discussed above, an alignment member 84 is located on the mating surface 78 of the main body 72. In the illustrated embodiment, the alignment member 84 comprises a rectangular-shaped raised protrusion that extends upward from the mating surface 78 of the main body 72, as best shown in FIGS. 4 and 5. The sides of the alignment member 84 are preferably sloped, as shown in FIG. 5, to facilitate insertion of the alignment member into the alignment opening 46 in the first elongate web 40. Additionally, the shape of the alignment member 84 substantially conforms to the shape of the alignment opening 46 (FIGS. 2 and 6). That is, the alignment member 84 is sized and shaped to be received by the alignment opening 46. The rectangular shape is easily manufactured and facilitates ease of insertion into the correspondingly-shaped alignment opening 46, although the shape of the alignment member 84 may be varied. In the illustrated embodiment, the alignment member 84 is centered around the longitudinal axis of the main body 72 and proximate the distal edge 77 of the main body 72.

In the illustrated embodiment, a circular aperture 85 also extends through the main body 72. The circular aperture 85 is located proximally of the alignment member 84. The circular aperture 85 may be provided to accommodate hardware passing through the rail controller 70.

Referring to FIG. 5, the rail controller 70 further includes a pair of wedge structures or interlock members 86*a*, 86*b* having a generally triangular cross-section that extend along the side edges 73*a*, 73*b* of the main body. The interlock members 86 extend outward in opposite directions from the upper portion of the side edges 73*a*, 73*b* of the main body 72. As shown, the height of the interlock members 86 is small relative to the height of the main body 72.

In the embodiment shown in FIGS. 3–5, the rail controller 70 includes a first control attachment 74 that extends from the distal edge 77 of the main body 72. The control attachment 74 comprises a pair of legs 90 that extend lengthwise distally from the main body 72. Each of the legs 90 has a proximal end connected to the distal edges 77 of the main body 72 and a distal end 94. The thickness of the legs increases moving toward the distal ends 94, as best seen in FIG. 4. The legs 90 are oriented at an angle θ relative to a plane defined by the main body 72. Preferably, the legs 90 are manufactured of a material that allows the legs 90 to be bent in a non-plastic manner such that the legs 90 can be oriented substantially parallel to the main body 72. This biases the legs 90 so that they spring back to the angled position shown in FIG. 4 after being released.

As shown in FIG. 4, a tab 96 extends from each of the distal ends 94 of the legs 90 so as to define a downwardly-facing step 97 at the distal ends 94. A wall 100 (FIG. 3) extends between the legs 90 to provide structural support thereto. In the illustrated embodiment, an elongated hole 99 extends through the wall 100.

Figures 7A, 7B, 7C, 7D, 7E:
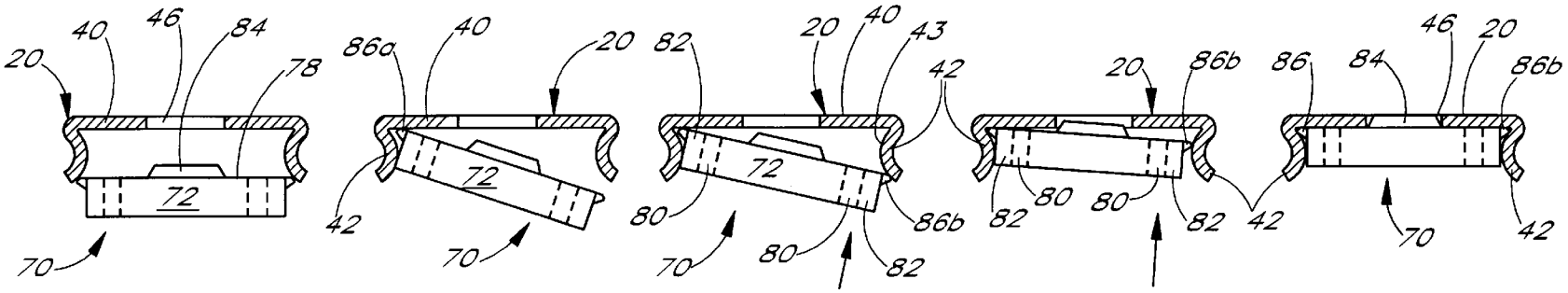
FIGS. 7A–7E schematically illustrate the process of mounting the rail controller of FIG. 2 to an inner rail of the rail assembly.

FIGS. 7A–7E are cross-sectional schematic views of the inner rail 20 and the rail controller 70. These figures illustrate the process by which the rail controller 70 is mounted to the inner rail 20. With reference to FIG. 7A, the rail controller 70 is first positioned adjacent the inner rail 20 with the mating surface 78 aligned substantially parallel to the first elongate web 40 of the inner rail 20. The alignment opening 46 in the first elongate web 40 facilitates correct placement of the rail controller relative to the inner rail 20. The alignment member 84 on the rail controller 70 is desirably aligned with the alignment opening 46 in the inner rail 20 member.

As shown in FIG. 7B, the main body 72 of the rail controller 70 is then tilted relative to the inner rail 20. The interlock member 86*a* is then positioned or wedged into a correspondingly-shaped nook formed at the juncture between the inner roll form 42 and first elongate web 40 of the inner rail 20. As shown in FIGS. 7C and 7D, an upward force is then applied to the rail controller 70 to force the second interlock member 86*b* to move into the other nook formed at the juncture between the inner roll form 42 and first elongate web 40. As the second interlock member 86*b* moves upward toward the nook, the main body 72 of the rail controller 70 must compress in width in order for the interlock member 86*b* to bypass the minimum space between the apex of each of the convex surface 43 of the inner roll form 42. This compression is facilitated by the elongated apertures 80, which allow the beam members 82 and the attached interlock members 86 to flex inward towards one another to reduce the width of the main body 72. Movement of the interlock member 86 into the space between the inner roll forms 42 is thus facilitated.

As shown in FIG. 7E, the rail controller 70 is pushed into the inner rail 20 until the interlock member 86*b* bypasses the convex portions of the inner roll forms 42. The rail controller main body 72 then expands in width so that the rail interlock members 86 spring into and seat between the inner roll forms 42. The alignment member 84 on the rail controller 70 also seats within the alignment opening 46 that extends through the inner rail 20. In this manner, the rail controller 70 is securely mounted to the inner rail 20. The above-described process can be reversed to easily remove the rail controller from the inner rail 20.

In use, the rail controller 70 is configured to inhibit movement of the inner rail 20 relative to the outer rail 26 in a predetermined direction so as to lock the slide assembly 19 in the open position. With reference again to FIG. 2, the proximal end 28 of the outer rail 26 is distally positioned beyond the distal ends 94 of the rail controller legs 90 when the slide assembly 19 is in the open position. With the inner rail 20 and outer rail 26 positioned as shown in FIG. 2, the legs 90 of the rail controller 70 prevent the inner rail 20 from sliding to a closed position. That is, the legs 90 prevent the inner rail from sliding in a distal direction, or in the direction of the arrow 103. The distal ends 94 of the legs 90 abut against the proximal of the outer rail 26 so that the legs 90 act as a stop. Preferably, the proximal end 28 of the outer rail 26 seats within the steps 97 (FIG. 4) on the distal ends 94 of the legs 90. It will be appreciated that the legs 90 do not prevent the inner rail 20 from sliding in a proximal direction (opposite the direction of the arrow 103).

Figure 8:
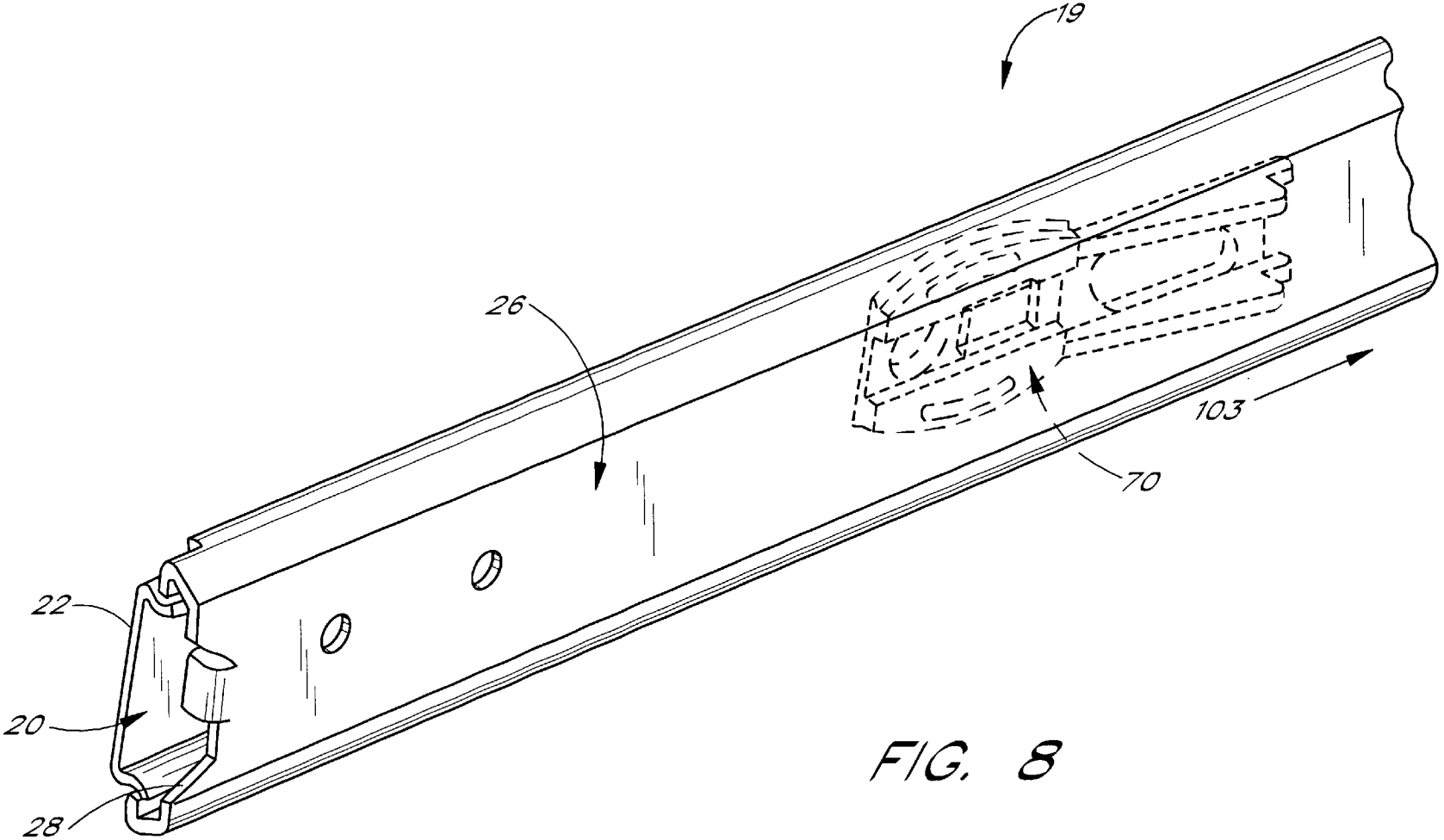
FIG. 8 is a second perspective view of the rail assembly of FIG. 2.

FIG. 8 shows the slide assembly 19 in a closed position. In the closed position, the inner rail 20 is fully nested over the outer rail 26 with the proximal ends 46 and 52 of the inner and outer rails 20 and 26 substantially aligned. The slide assembly 19 may be moved to the closed position by releasing the rail controller 70 from engagement with the proximal end 28 of the outer rail 26. This is accomplished by pushing the legs 90 of the rail controller 70 in the inboard direction so that the legs 90 are moved from abutment with the outer rail 26. When the legs 90 are released from engagement with the outer rail 26, the inner rail 20 is free to be moved distally, or in the direction of the arrow 103. In the closed position, the rail controller 70 is positioned between the elongate webs of inner rail 20 and outer rail 26, such as shown in FIG. 8. When the inner rail 20 is again moved to the open position, the legs 90 on the rail controller 70 spring open to automatically engage the proximal end 28 of the outer rail 26 to automatically lock the slide assembly 19 open.

Figure 9:
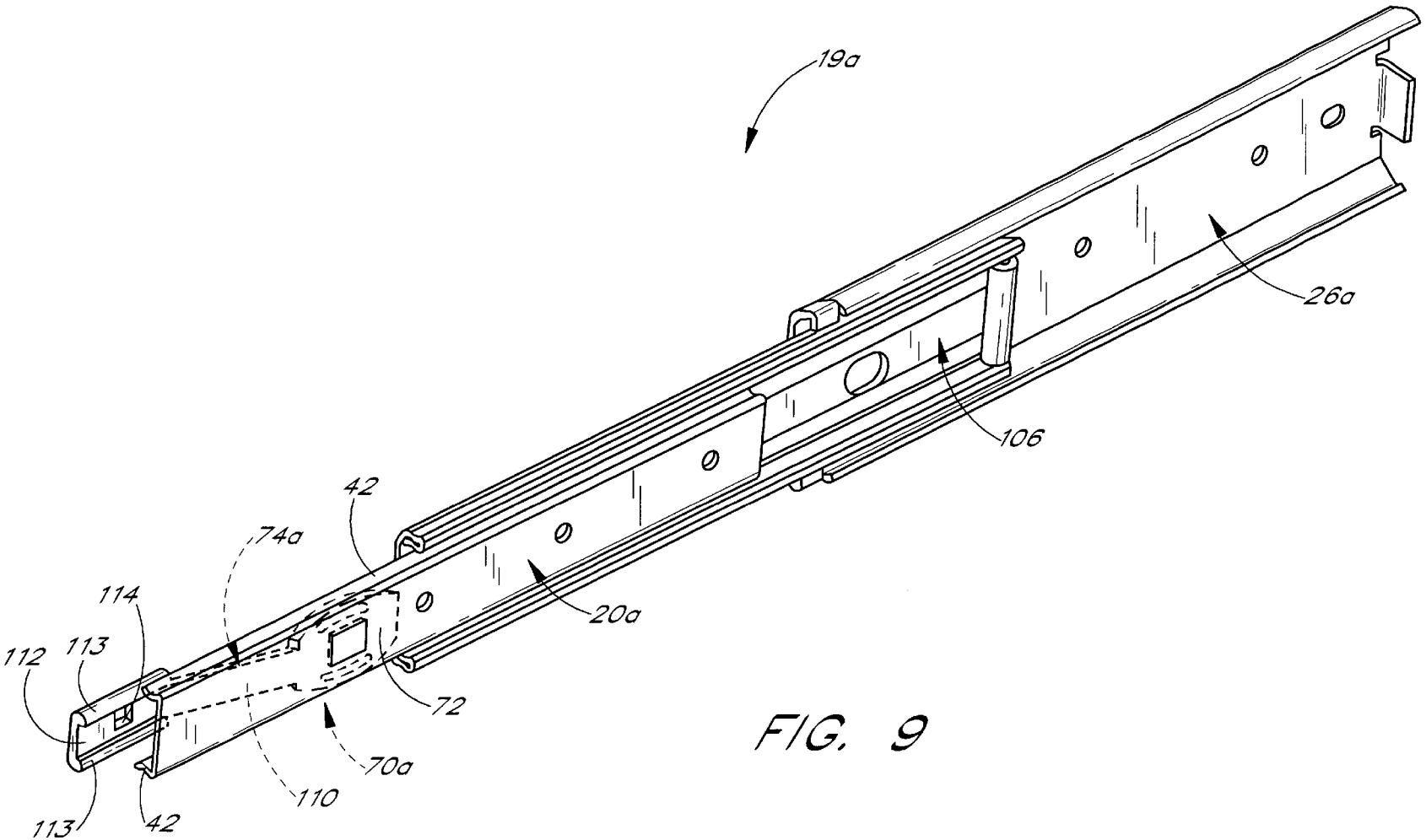
FIG. 9 is a perspective view of another embodiment of the rail assembly in an "open" position.

FIG. 9 is a perspective view, looking in the outboard direction, of a second embodiment of the slide assembly, referred to as slide assembly 19*a*. Like reference numerals will be used between like parts of the embodiments for ease of understanding. In FIG. 9, the slide assembly 19*a* is shown in an "open" position, as described above with respect to the previous embodiment. The slide assembly 19*a* comprises an inner rail 20*a*, an outer rail 26*a*, and an intermediate rail 106 slidably mounted therebetween. Each of the rails 20*a*, 26*a*, and 106 are slidably movable relative to each other in a well known manner, such as described above with respect to the previous embodiment.

Figure 9A:
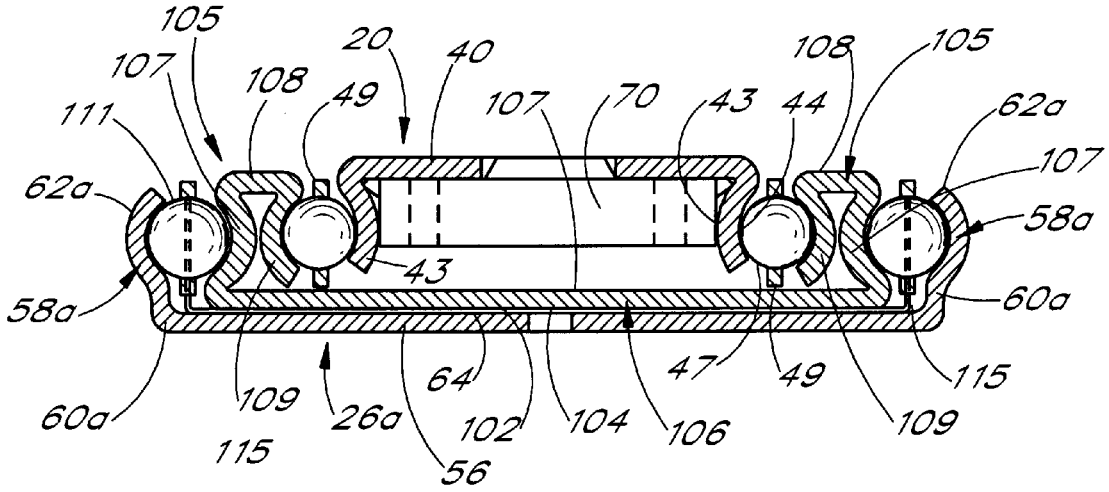
FIG. 9A is a cross-sectional view of the rail assembly of FIG. 9 taken along the line 9*a*—9*a* of FIG. 10.
Figure 10:
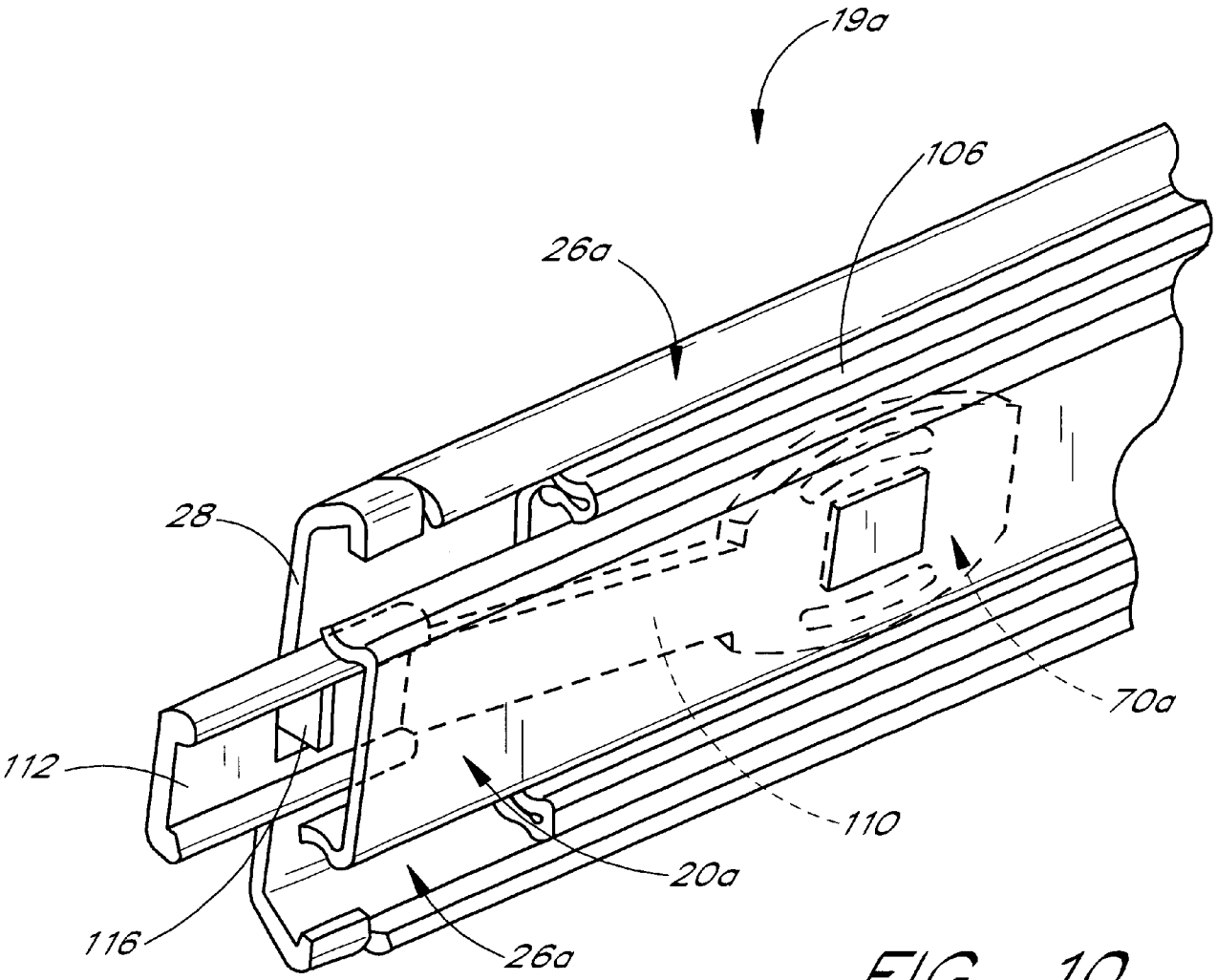
FIG. 10 is a perspective view of the rail assembly of FIG. 9 in a "closed" position.

FIG. 9A is a cross-sectional view of the slide assembly 19*a* taken along the line 9A—9A of FIG. 10. As shown, the inner rail 20*a* includes a first elongate web 40 and a pair of inner roll forms 42 extending from the sides of the first elongate web. As discussed above regarding the previous embodiment, the inner roll forms each comprise a curved wall defining a convex surface 43 and an opposed concave surface 44. The inner rail 20*a* is slidably nested within the intermediate rail 106.

The intermediate rail 106 comprises a midportion or elongate web 102 having a flat inboard surface 101 and an opposed flat outboard surface 104. A pair of intermediate roll forms 105 extend from the sides of the elongate web 102. The intermediate roll forms 105 each comprise a wall having a first curved portion 107 that extends from the elongate web 102. The first curved portion 107 forms into a straight connector portion 108 which forms into a second curved portion 109 having a curvature opposite that of the first curved portion 107. A gap is defined between the second curved portion 109 and the concave surface 44 of the inner roll form 42. A plurality of ball bearing 47 are positioned within this gap. The ball bearings 47 are interconnected by a race 49 that extends through the ball bearings 47 in a well known manner.

The outer rail 26*a* comprises a flat second elongate web 56, as described above regarding the previous embodiment. A pair of outer roll forms 58*a* extend from the edges of the second elongate web 56. The outer roll forms 58*a* each comprise a bent wall including a straight first wall portion 60*a* that extends from the elongate web 56. The outer roll forms 58 then bend to form a second wall portion 62*a* that has a curvature opposite the curvature of the second curved portion 109 of the intermediate roll forms 105 so as to form a gap therebetween. A plurality of ball bearings 111 are positioned within this gap. The ball bearings are connected by a flat bridge 115 that extends along the inboard surface 64 of the outer elongate web 56.

The intermediate rail 106 is nested between the outer roll forms 58 of the outer rail 26*a*. The outboard surface 104 of the intermediate rail elongate web 102 is positioned flushly adjacent the inboard surface 64 of the outer elongate web

26*a*. In operation, the intermediate elongate web 102 slides along the inboard surface 64 of the outer elongate web 56 with the ball bearing bridge 115 positioned between the intermediate elongate web 102 and the outer elongate web 56.

As shown in FIGS. 9 and 9A, a rail controller 70*a* is removably mounted to the inner rail 20*a*. The rail controller 70*a* is mounted between the pair of inner roll forms 42 on the inner rail 20*a* in the same manner described above with respect to the previous embodiment. The rail controller 70*a* includes a main body 72 that is identical to the main body 72 described above with respect to the previous embodiment. As shown, the main body 72 is sized and positioned so as not to interfere with the slidability of any of the rails relative to one another.

A control attachment 74*a* extends in a proximal direction from one end of the main body 72 of the rail controller 70. The control attachment 74*a* is configured to lock the slide assembly 19*a* in a "closed" position, as described more fully below.

With reference to FIG. 9, the control attachment 74*a* comprises a thin and flat elongated arm 110 that extends in a proximal direction from the main body 72. The elongated arm 110 is oriented at an angle relative to a plane defined by the main body 72. A proximal end of the elongated arm 110 forms into a rectangular, planar lock member 112. A pair of protruding lips 113 extend along the sides of the lock member 112. A rectangular aperture 114 extends through the lock member 112. The aperture 114 is configured to mate with a locking tab 116 (FIG. 10) located on the outer rail 26 near its proximal end 28, as described in detail below.

FIG. 10 shows the slide assembly 19*a* in a closed position in which the inner rail 20*a* and the intermediate rail 106 are nested entirely within the outer rail 26*a*. When the inner rail 20*a* and the intermediate rail 106 are slid into the closed position, the locking tab 116 that extends from the outer rail 26*a* automatically engages or snaps into the aperture 114 on the locking member 112. The engagement between the locking tab 116 and the aperture 114 inhibits the inner rail 20*a* from sliding relative to the outer rail 26*a*. The slide assembly 19*a* is thus locked in the closed position. When desired, the lock member 112 may be pulled away from the outer rail 26*a* to remove the aperture 114 from engagement with the locking tab 116. The slide assembly 19*a* is then free to be moved to the open position.

As shown in FIG. 9, a rail controller 70*a* is removably mounted to the inner rail 20*a*. The rail controller 70*a* is mounted between a pair of inner roll forms 42 on the inner rail 20*a* in the same manner described above with respect to the previous embodiment. The rail controller 70*a* includes a main body 72 that is identical to the main body 72 described above with respect to the previous embodiment. A control attachment 74*a* extends in a proximal direction from one end of the main body 72 of the rail controller 70. The control attachment 74*a* is configured to lock the slide assembly 19*a* in a "closed" position, as described more fully below.

The control attachment 74*a* comprises a thin and flat elongated arm 110 that extends in a proximal direction from the main body 72. The elongated arm 110 is oriented at an angle relative to a plane defined by the main body 72. A proximal end of the elongated arm 110 forms into a rectangular, planar lock member 112. A pair of protruding flanges 113 extend along the sides of the lock member 112. A rectangular aperture 114 extends through the lock member 112. The aperture 114 is configured to mate with a locking tab 116 (FIG. 10) located on the outer rail 26 near its proximal end 28, as described in detail below.

FIG. 10 shows the slide assembly 19*a* in a closed position in which the inner rail 20*a* and the intermediate rail 106 are nested entirely within the outer rail 26*a*. When the inner rail 20*a* and the intermediate rail 106 are slid into the closed position, the locking tab 116 that extends from the outer rail 26*a* automatically engages or snaps into the aperture 114 on the locking member 112. The engagement between the locking tab 116 and the aperture 114 inhibits the inner rail 20*a* from sliding relative to the outer rail 26*a*. The slide assembly 19*a* is thus locked in the closed position. When desired, the lock member 112 may be pulled away from the outer rail 26*a* to remove the aperture 114 from engagement with the locking tab 116. The slide assembly 19*a* is then free to be moved to the open position.

Figure 11:
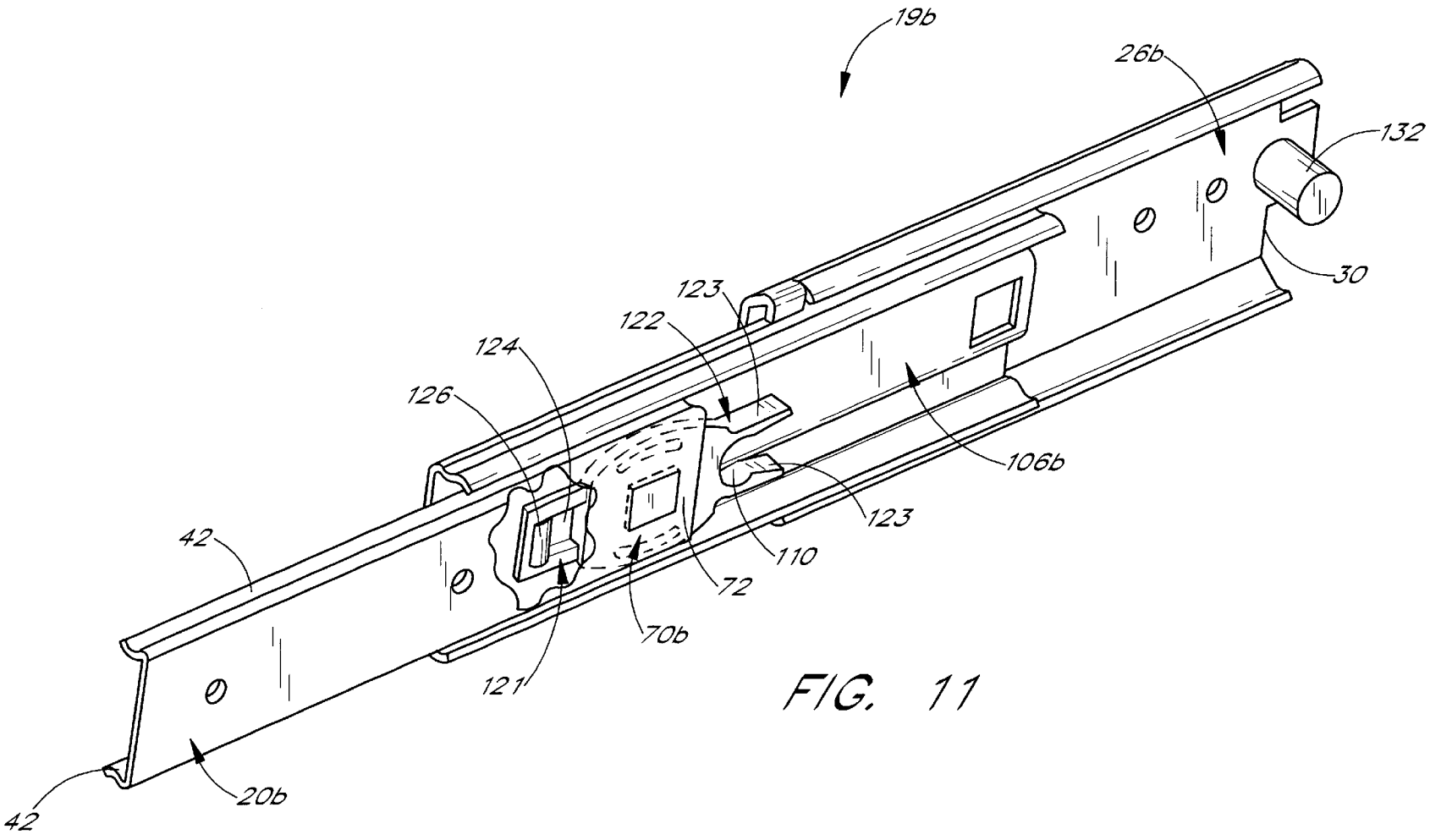
FIG. 11 is a perspective view of yet another embodiment of the rail assembly in an "open" position.

FIG. 11 is a perspective view of a third embodiment of the slide assembly,. referred to as slide assembly 19*b*. Like reference numerals will be used between like parts of the embodiments for ease of understanding. In FIG. 11, the slide assembly 19*b* is shown in an "open" position, as described above with respect to the previous embodiments. The slide assembly 19*b* comprises an inner rail 20*b*, an outer rail 26*b*, and an intermediate rail 106*b* slidably mounted therebetween. Each of the rails 20*b*, 26*b*, and 106*b* are slidably movable relative to each other in a well known manner, such as described above with respect to the previous embodiments.

As shown in FIG. 11, a rail controller 70*b* is removably mounted to the inner rail 20*b*. As discussed above with respect to the previous embodiments, the rail controller 70*b* is mounted between a pair of inner roll forms 42 of the inner rail 20*b*. The rail controller 70*b* includes a main body 72 that is identical to the main body 72 described above with respect to the first embodiment. A first control attachment 121 extends in a proximal direction from one side of the main body 72. The control attachment 121 comprises a u-shaped rail that extends from the main body 72. The u-shaped rail defines a rectangular locking aperture 124 therein that is sized to receive a raised tab or surface 126 located on the intermediate rail 106*b*. The control attachment 121 is configured to removably lock the slide assembly 19*b* in the open position, as described more fully below.

The rail controller 70*b* further includes a second control attachment 122 that extends distally from the side of the main body 72 opposite the location of the control attachment 121. The control attachment 122 comprises a pair of forked arms 123, a portion of which are shaped to define a circular opening 110 therebetween. The forked arms 123 widen at their tips so as to create a widened entrance into the circular opening 110. The circular opening 110 defined by the forked arms 123 is sized to receive a correspondingly-shaped locking pin 132 that extends from the outer rail 26 near its distal end 30. The control attachment 122 is configured to retain the slide assembly 19*b* in a closed position, as described more fully below.

Referring to FIG. 11, when the slide assembly 19*b* is in the open position, the raised surface 126 on the intermediate rail 106*b* seats within the control attachment 121 so as to extend through the locking aperture 124. With the raised surface 126 engaged with the control attachment 121 in this manner, the inner rail 20 is inhibited from sliding relative to the intermediate rail 106 so that the slide assembly is locked in the open position. However, a threshold amount of force may be applied to the inner rail 20 to force the raised surface 126 to pop out of the locking aperture 124 and thereby release the control attachment 121 from engagement with the intermediate rail 106.

Figure 12:
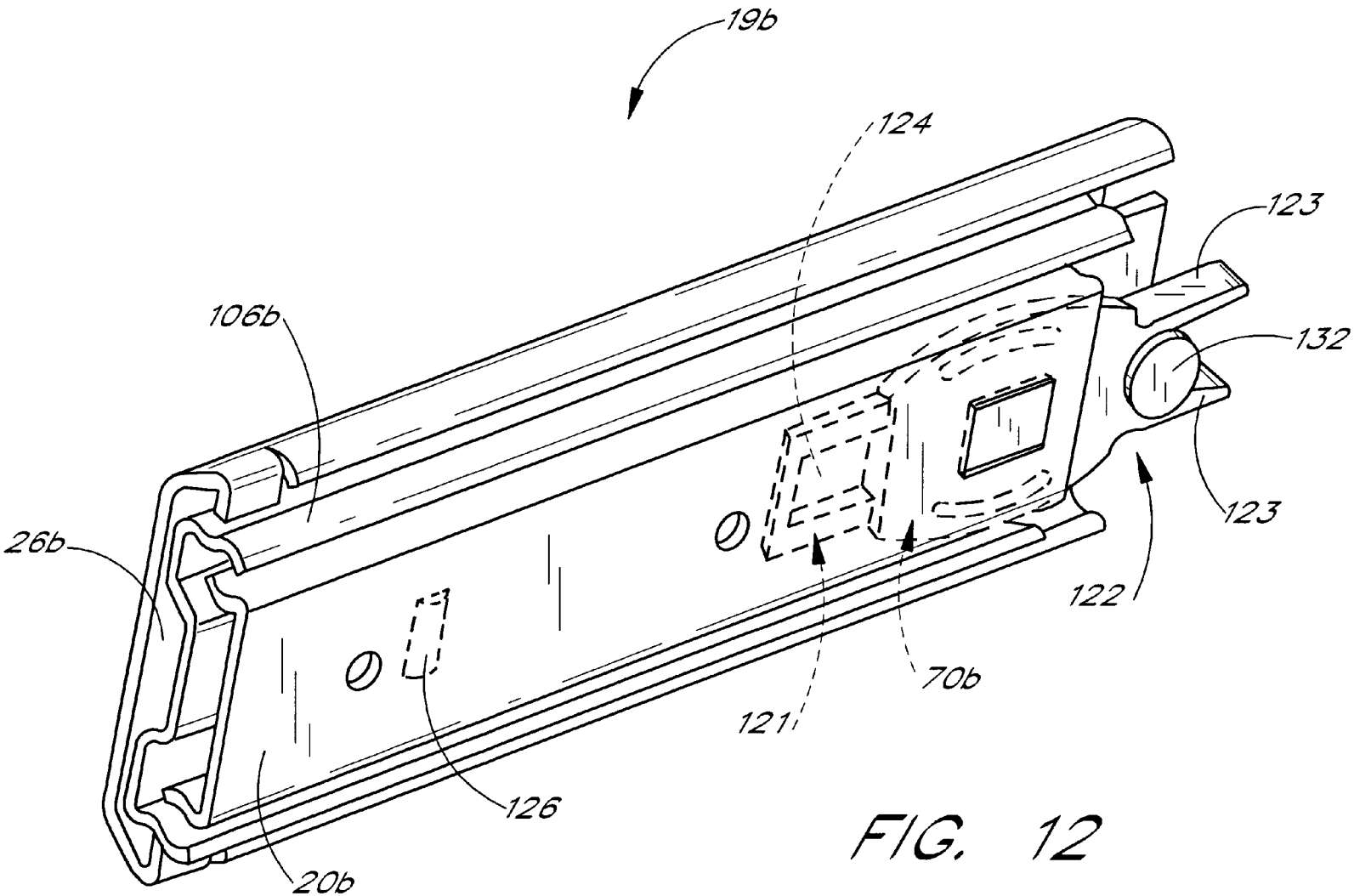
FIG. 12 is a perspective view of the rail assembly of FIG. 11 in a "closed" position.

FIG. 12 shows the slide assembly 19*b* in a closed position. In the closed position, the control attachment 122 on the rail controller engages with the locking pin 132 to thereby retain the slide assembly 19*b* in the closed position by inhibiting the inner rail 20*b* from sliding relative to the outer rail 26*b*. Specifically, the locking pin 132 is positioned within the circular opening 110 and compressed between the forked arms 123 of the control attachment 122. A threshold force may be applied to the inner rail 20 to pull the locking pin 132 from engagement with the forked arms 123 of the control attachment 122 and slide the slide assembly 19*b* to the open position.

The slide control characteristics of a particular slide assembly is determined by the particular rail controller that is mounted on the slide assembly. For instance, the rail controller 70 is used to provide a slide assembly with locked-open capability. The rail controller 70*a* is used to provide a slide assembly with locked-close capability. The rail controller 70*b* is used to provide detents in the open and closed positions. Advantageously, in each of the embodiments of the slide assemblies described herein, the structural configuration of the rail controller main body 72 remains substantially identical. The main body 70 is the only portion of the rail controller that mounts onto the slide assembly. Thus, the rail controllers 70, 70*a,* and 70*b* may each be easily mounted and removed from the slide assembly regardless of the particular control attachment by using the snap-fit process described with reference to FIGS. 7A–7E. Advantageously, the snap-fit mounting configuration also allows the rail controllers 70–70C to be attached to the slide assembly without the use of tools.

Figure 13:
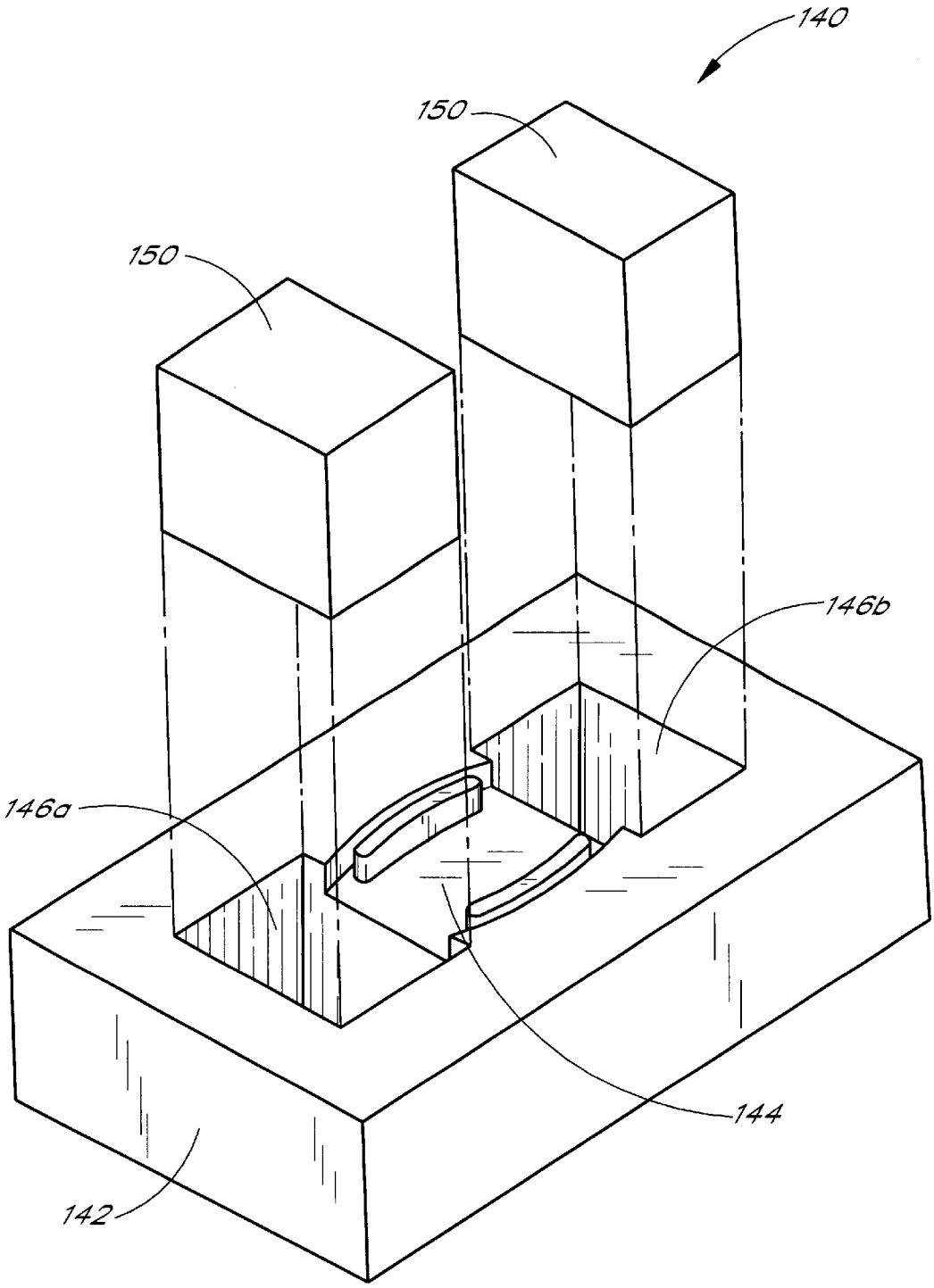
FIG. 13 is a perspective view of a modular mold assembly used to manufacture the rail controller.

It is contemplated that any of the embodiments of the rail controller 70 may be manufactured using a molding process. FIG. 13 shows a modular mold assembly 140 that may advantageously be used to manufacture any of the embodiments of the rail controller 70. The mold assembly 140 comprises a lower base mold 142 that defines a central mold cavity 144 having a structural configuration forming a relief of the shape of the rail controller main body 72. The lower base mold 142 also defines a pair of rectangular modular mold cavities 146*a* and 146*b* on either side of the central mold cavity 144. The modular mold cavities 146*a,* 146*b* are configured to receive any of a variety of add-on molds 150 for manufacturing the various embodiments of the rail controllers described above. An upper base mold 152 (FIG. 15) fits over the lower base mold to enclose the mold cavities 144, 146*a*, and 146*b* during the molding process, as described more fully below.

Figure 14:
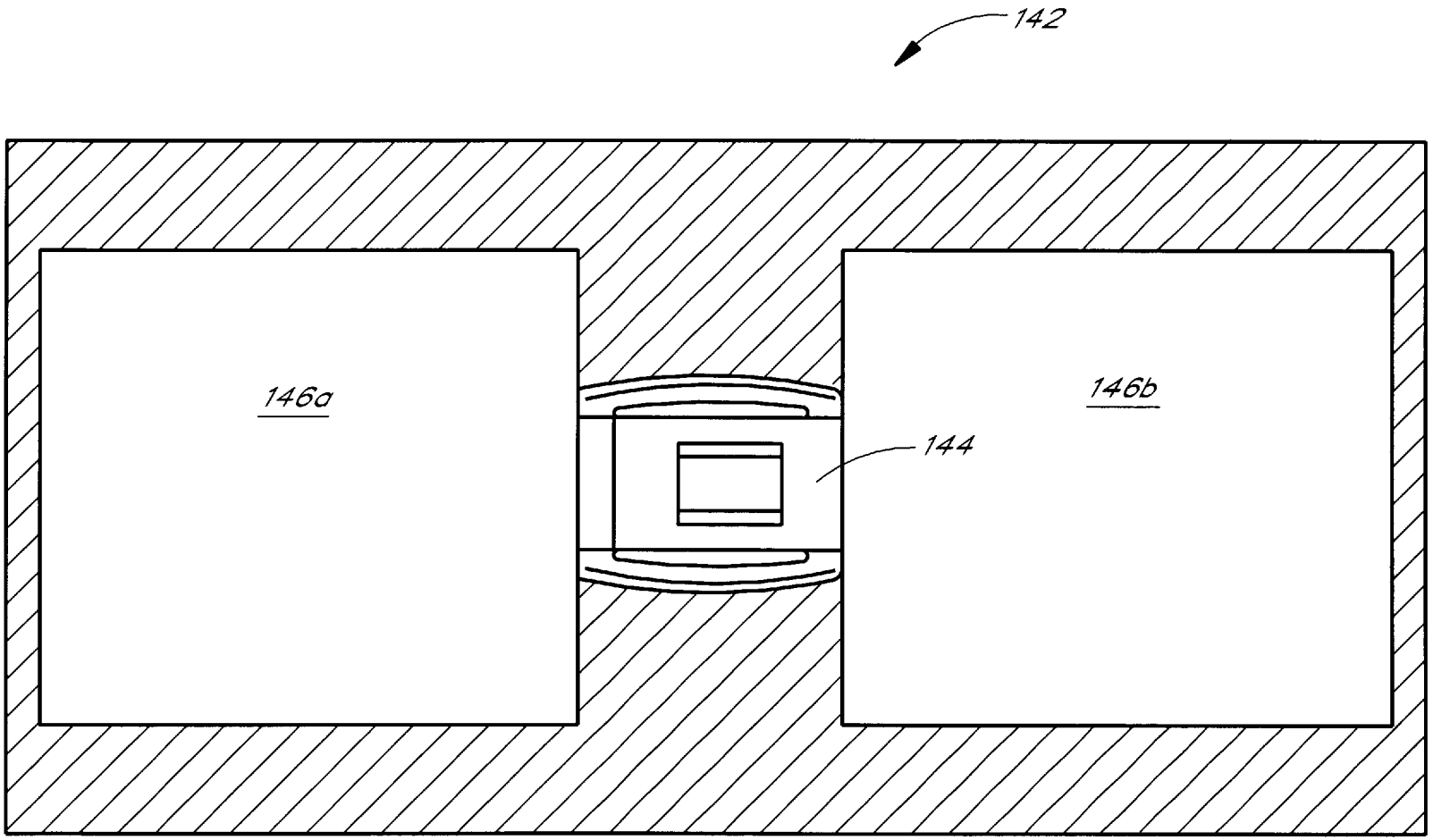
FIG. 14 is a top view of a lower portion of a base mold used with the mold assembly of FIG. 13.

FIG. 14 is a top view of the lower base mold 142 of FIG. 13. As shown, the central mold cavity 144 in the lower base mold 142 defines a mold shape that is configured to form the rail controller main body 72. As mentioned, the structure of the main body 72 is identical for the different embodiments of the rail controller 70. Thus, the central mold cavity 144 can advantageously have the same structure for manufacturing any of the embodiments of the rail controller 70.

Figure 15:
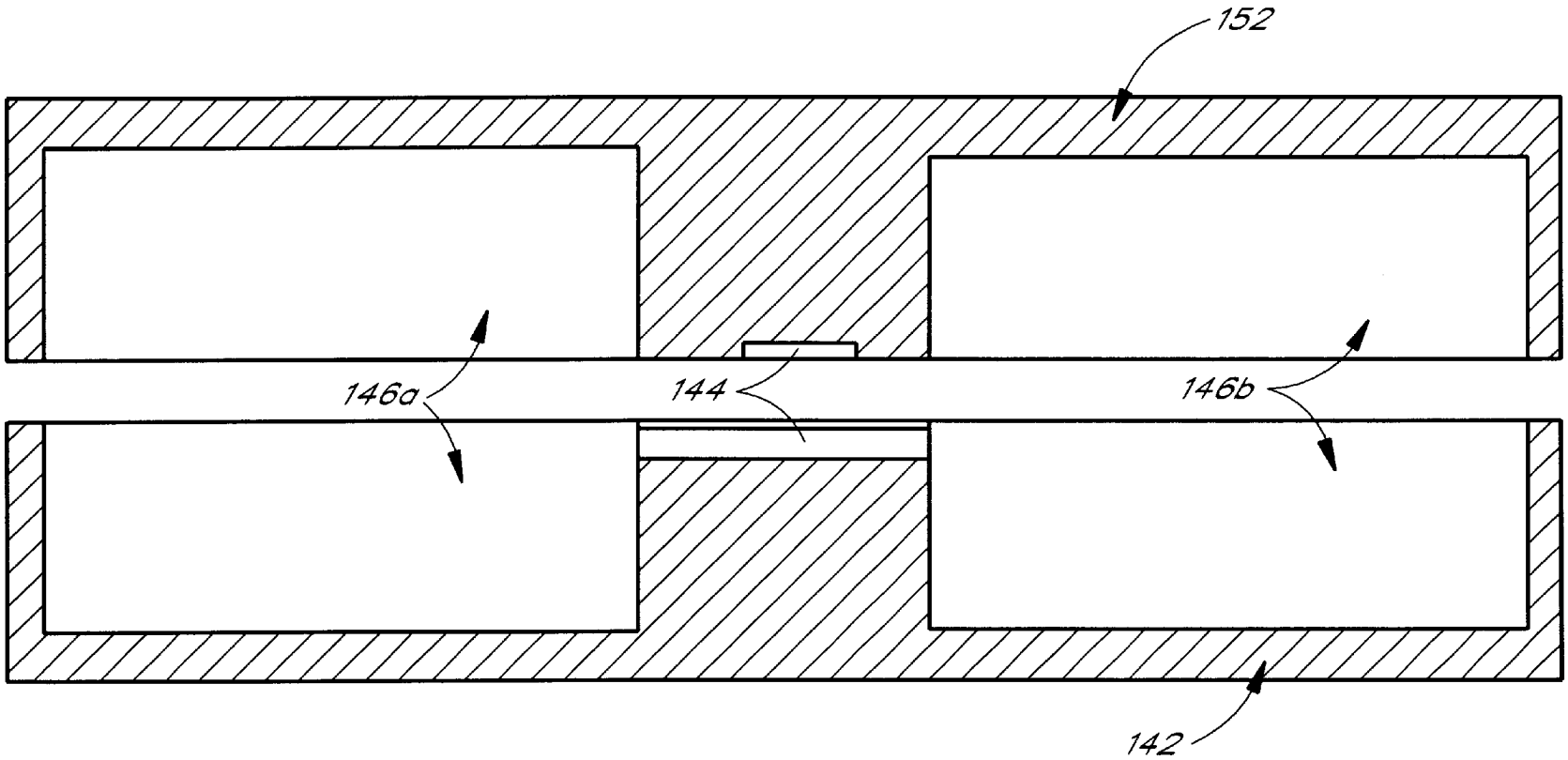
FIG. 15 is a side view of upper and lower portions of the base mold.

FIG. 15 is a side view of the lower base mold 142 and upper base mold 152. When pressed together, the lower base mold 146 and upper base mold 152 cooperate to define the main cavity 144 therebetween for molding the main body 72 of the rail controller 70. The lower base mold 146 and upper base mold 152 also define the modular mold cavities 146*a,* 146*b* therebetween that are sized to receive any of a wide variety of the add-on molds 150, as described below.

The particular add-on mold 150 that is used will be dependent on the particular embodiment of rail controller that is to be manufactured. In this manner, a single base mold 142 may be used to manufacture any of the embodiments of the rail controllers 70. This simplifies the manufacturing process and also reduces the associated tooling costs.

Figure 17:
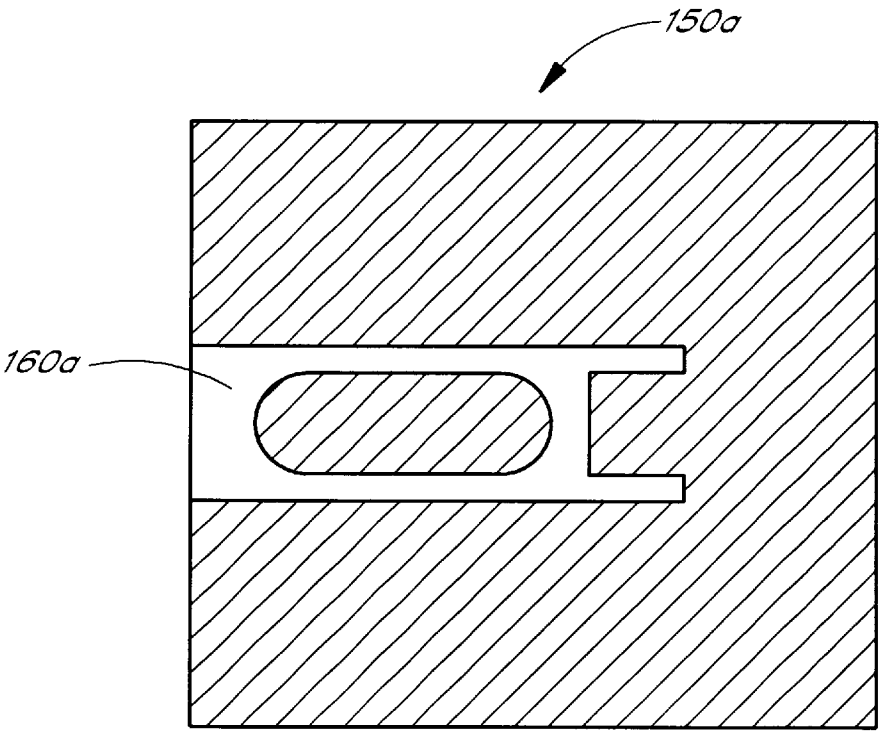
FIG. 17 is a top view of a cavity defined by the add-on mold of FIG. 16.
Figure 16:
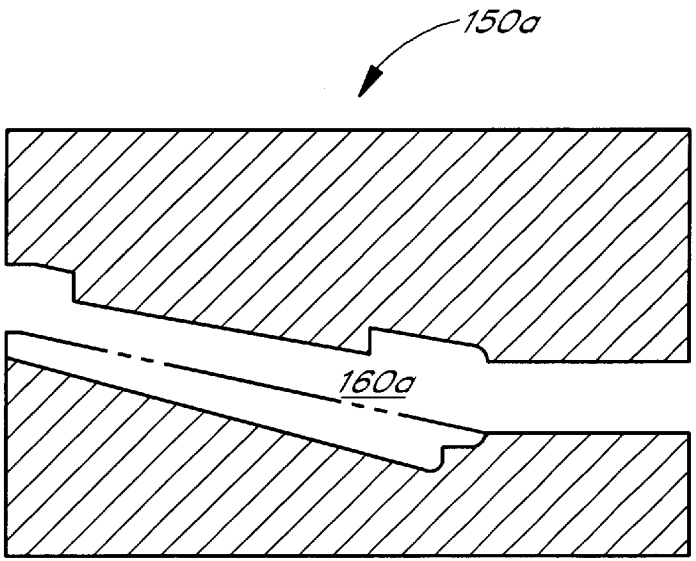
FIG. 16 is a side view of upper and lower portions of an add-on mold used with the mold assembly of FIG. 13.

FIG. 16 is a side view of an add-on mold 150*a* for manufacturing the rail controller 74 illustrated in FIGS. 3–5. As shown, the add on mold 150*a* comprises upper and lower portions that define a control attachment mold cavity 160*a* therebetween having a shape corresponding to the shape of the rail controller 74. FIG. 17 shows a top view of the cavity 160*a* formed by the add-on mold 150*a*.

Figure 19:
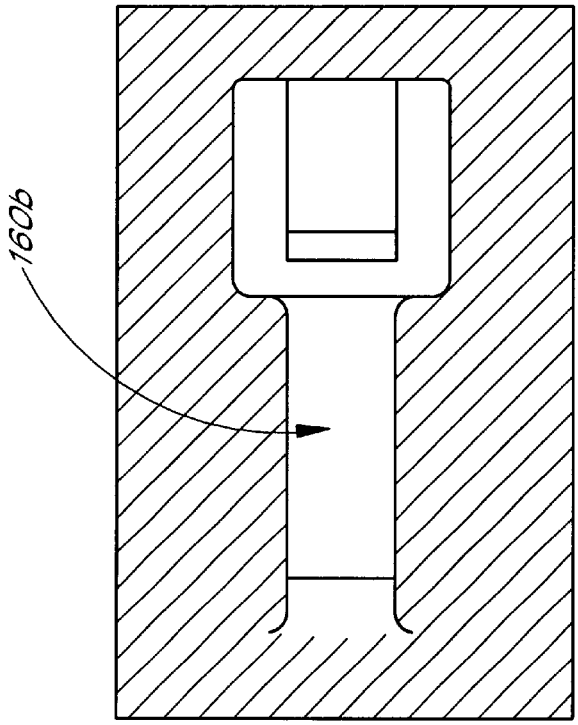
FIG. 19 is a top view of a cavity defined by the add-on mold of FIG. 18.
Figure 18:
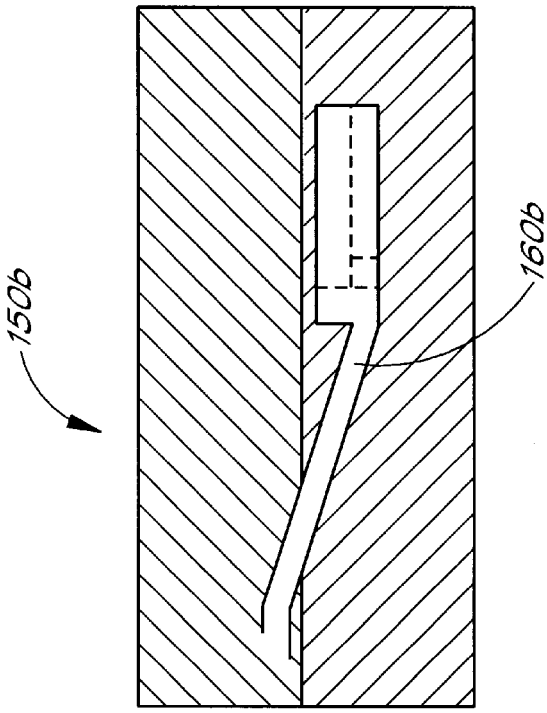
FIG. 18 is a side view of upper and lower portions of another embodiment of an add-on mold used with the mold assembly of FIG. 13.

FIG. 18 is a side view of an add-on mold 150*b* for manufacturing the rail controller 74*a* illustrated in FIGS. 9–10. As shown, the add on mold 150*b* comprises upper and lower portions that define a cavity 160*b* therebetween having a shape corresponding to the shape of the rail controller 74*a*. FIG. 19 shows a top view of the cavity 160*b* formed by the add-on mold 150*b*.

Figure 21:
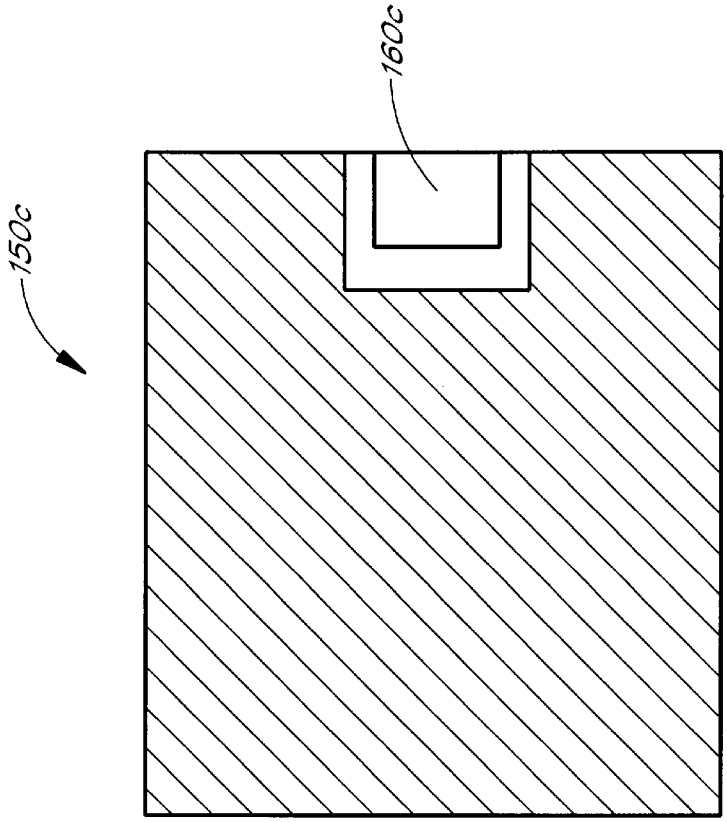
FIG. 21 is a top view of a cavity defined by the add-on mold of FIG. 20.
Figure 20:
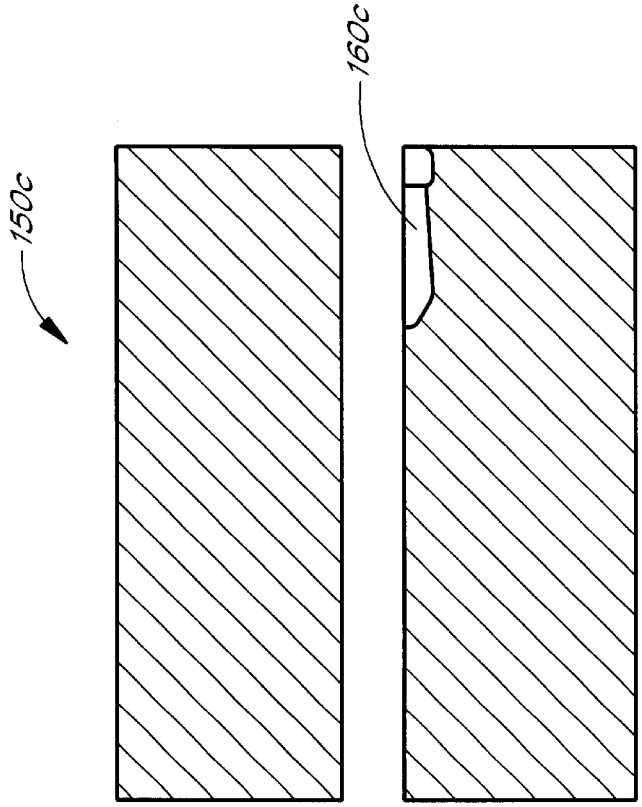
FIG. 20 is a side view of upper and lower portions of another embodiment of an add-on mold used with the mold assembly of FIG. 13.
Figure 23:
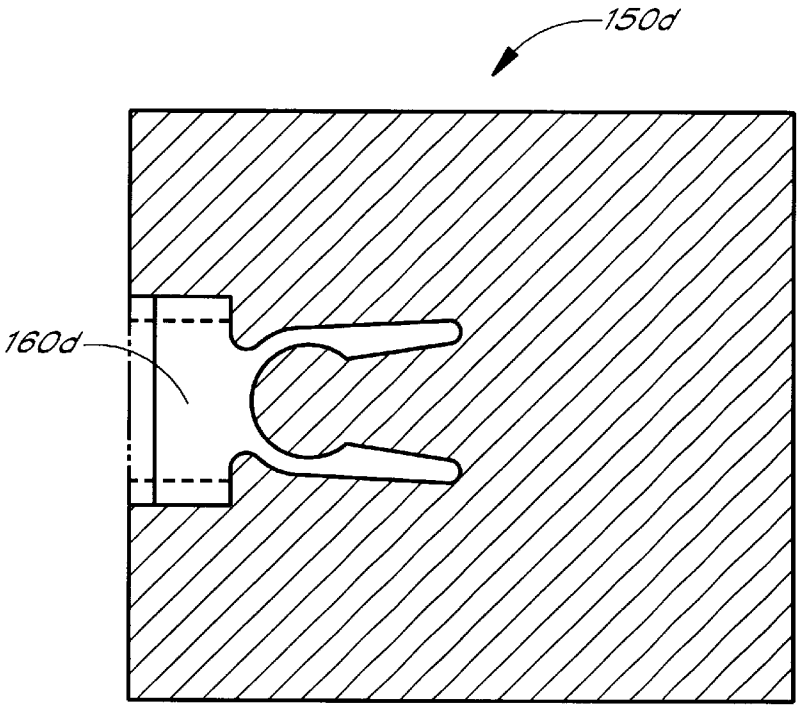
FIG. 23 is a top view of a cavity defined by the add-on mold of FIG. 22.

FIG. 20 is a side view of an add-on mold 150*c* for manufacturing the rail controller 121 illustrated in FIGS. 11–12. As shown, the add on mold 150*c* comprises upper and lower portions that define a cavity 160*c* therebetween having a shape corresponding to the shape of the rail controller 121. FIG. 21 shows a top view of the cavity 160*c* formed by the add-on mold 150*c*.

Figure 22:
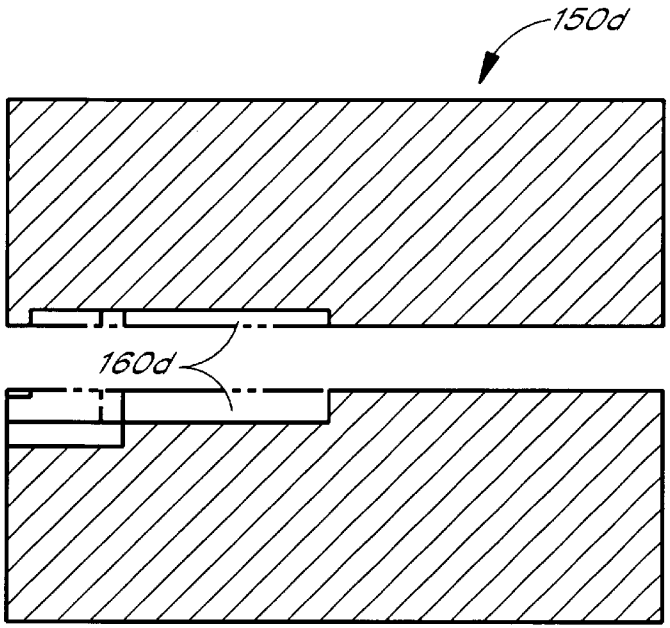
FIG. 22 is a side view of upper and lower portions of another embodiment of an add-on mold used with the mold assembly of FIG. 13.

FIG. 22 is a side view of an add-on mold 150*d* for manufacturing the rail controller 122 illustrated in FIGS. 11–12. As shown, the add on mold 150*d* comprises upper and lower portions that define a cavity 160*d* therebetween having a shape corresponding to the shape of the rail controller 122. FIG. 22 shows a top view of the cavity 160*d* formed by the add-on mold 150*d*.

The molding process comprises selecting an add-on mold 150 that corresponds to the particular embodiment of control attachment that is to be manufactured. For example, the add-on mold 150*a* is selected when manufacturing a rail controller 70 with the control attachment 74 shown in FIGS. 3–5. The desired add-on mold 150 is then inserted into one of the modular mold cavities 146 in the base mold 142. If desired, a second add-on mold 150 may be inserted into the other modular mold cavity 146. If no add-on mold is to be used, a solid box-shaped blank is inserted into the mold to prevent entry of the molding material into the modular mold cavities.

The top portion of the base mold 142 is then positioned atop the lower portion of the base mold 142 to define the central mold cavity 144 and control attachment mold cavity 160 therebetween. A mold substance, such as an acetyl (preferably TEFLON-filled DELRIN manufactured by DuPont) having an NC100 rating or similar durable synthetic material, is then injected into the cavities and the base mold 142 is then heated and cooled. After cooling, the upper and lower portions of the base mold 142 are separated to produce the rail controller.

The substance used to manufacture the rail controller 70 desirably provides high strength and also provides excellent wear characteristics to the rail controller 70. Additionally, the substance desirably has excellent "memory" characteristics. That is, the substance is preferably resilient so as to return to its original shape after being deformed in a non-plastic manner.

The above-described process advantageously allows any of the embodiments of the rail controller 170 to be manufactured using a single base mold 142. The add-on molds 150 may be varied to change the particular control attachment that is manufactured. The shape of main body 72 advantageously does not change so that the rail controller 70 is easily mounted to a slide assembly regardless of the particular control attachment used.

Although the foregoing description of the preferred embodiment of the preferred invention has shown, described, and pointed out certain novel features of the invention, it will be understood that various omissions, substitutions, and changes in the form of the detail of the apparatus as illustrated as well as the uses thereof, may be made by those skilled in the art without departing from the spirit of the present invention. Consequently, the scope of the present invention should not be limited by the foregoing discussion, which is intended to illustrate rather than limit the scope of the invention.

What is claimed is:

1. A controller for a rail comprising a first elongate web between a first elongate outer roll form on one side and a second elongate outer roll form on an opposing side, said web defining an opening, said controller comprising:

a body defining a first end, a second end, a first side, a second side, a mating surface sized and shaped to be positioned against said web, said body further defining a projection extending from said mating surface sized and shaped to fit within said opening;

said body defining a first elongate aperture and a first resilient beam along said first side of said body outboard from said first elongate aperture;

a first interlock projecting outward from an outer portion of said first beam adjacent said mating surface retainable beneath said first outer roll form; and a second interlock projecting outward from an outer portion of said second side of said body adjacent said mating surface retainable beneath said second outer roll form;

said first aperture sized and shaped to permit said first beam member to flex inward to a first position wherein said body is insertable between said first roll form and said second roll form and to resiliently move outward to a second position wherein said body is secured with said first interlock beneath said first roll form and said second interlock beneath said second roll form with said projection extending through said opening and said mating surface positioned against said web.

2. The controller of claim 1, wherein said first and second interlock members each comprise a wedge structure having a triangle-shaped cross-section.

3. The controller of claim 1, wherein said controller further comprises a first control attachment extending from said first end.

4. The controller of claim 3, wherein said first control attachment is selected from the group of a lock and a detent.

5. The controller of claim 3, wherein said controller further comprises a second control attachment extending from said second end.

6. The controller of claim 5, wherein said first control attachment is selected from the group of a lock and a detent and said second control attachment is selected from the group of a lock and a detent.

7. The controller of claim 1, wherein said body further defines a second elongate aperture and a second resilient beam along said second side of said body outboard from said second elongate aperture, said second interlock projecting outward from an outer portion of said second beam adjacent said mating surface and retainable beneath said second outer roll form.

8. The controller of claim 7, wherein said first beam member is configured to be flexed inward toward said first elongate aperture and said second beam member is configured to be flexed inward toward said second elongate aperture to reduce the width of the main body.

* * * * *